US005722891A

United States Patent [19]

Inoue

[11] Patent Number: 5,722,891

[45] Date of Patent: Mar. 3, 1998

[54] SLOT MACHINE HAVING TWO DISTINCT SETS OF REELS

[75] Inventor: Haruo Inoue, Tokyo, Japan

[73] Assignee: Eagle Co., Ltd., Tokyo, Japan

[21] Appl. No.: 399,922

[22] Filed: Mar. 7, 1995

[30] Foreign Application Priority Data

Apr. 5, 1994 [JP] Japan ..... 6-067171

[51] Int. Cl.[6] ..... A63F 9/22

[52] U.S. Cl. ..... 463/20; 273/143 R

[58] Field of Search ..... 463/20, 21, 25; 273/143 R, 138 A; 364/412, 410

[56] References Cited

U.S. PATENT DOCUMENTS

| | | | |
|---|---|---|---|
| 4,624,459 | 11/1986 | Kaufman | 463/20 |
| 5,067,712 | 11/1991 | Georgilas | 463/21 |
| 5,152,529 | 10/1992 | Okada | 463/20 |
| 5,380,008 | 1/1995 | Mathis et al. | 463/20 X |
| 5,395,111 | 3/1995 | Inoue | 463/20 X |

FOREIGN PATENT DOCUMENTS

| | | | |
|---|---|---|---|
| 59-193487 | 12/1984 | Japan . | |
| 60-227787 | 11/1985 | Japan . | |
| 62-253091 | 11/1987 | Japan . | |
| 1-130384 | 9/1989 | Japan . | |
| 3-136683 | 6/1991 | Japan . | |
| 5237217 | 9/1993 | Japan . | |
| 7275432 | 10/1995 | Japan . | |
| 7313661 | 12/1995 | Japan . | |
| 2097160 | 10/1982 | United Kingdom | 273/138 A |
| 2153572 | 7/1985 | United Kingdom | 273/143 R |
| 2170636 | 8/1986 | United Kingdom | 273/143 R |
| 2226907 | 7/1990 | United Kingdom | 273/143 R |

*Primary Examiner*—Jessica Harrison
*Assistant Examiner*—Michael O'Neill
*Attorney, Agent, or Firm*—Young & Thompson

[57] ABSTRACT

A slot machine for playing games has a set of three normal reels, with symbols arranged on their peripheries. The normal reels are rotated in a normal game, and are stopped to determine a win, in accordance with a combination of symbols of the normal reels along a predetermined first winning line. A win is selected from a normal win and a specific win. A bonus game is triggered when the specific win is provided. There is at least one specific reel having symbols which are arranged on its periphery. The specific reel is rotated in the bonus game, and is stopped to determine the win, in accordance with a symbol on the specific reel at a predetermined winning position.

26 Claims, 5 Drawing Sheets

SLOT MACHINE HAVING TWO DISTINCT SETS OF REELS

BACKGROUND OF THE INVENTION

1. Field of the Invention

The present invention relates to a slot machine. More particularly, the present invention relates to a slot machine in which the appearance and the operation of reels are so improved as to heighten the player's interest in games played therewith.

2. The Prior Art

Slot machines are popular with game players no less than pinball machines. A slot machine has a set of symbol-bearing reels, or a CRT showing images of such rotary reels. At least one coin, token, medal or other disk of a predetermined kind (hereinafter referred to as a coin) is inserted into the slot machine, before a start button or start lever is externally operated to start playing a game. The reels and the like are rotated and then stopped according to probability, which is responsive to depression of stop buttons, or simply to a lapse of suitable time. A stopped combination of symbols appears along a winning line defined across the front of the reels. If the symbol combination as stopped is a specific winning combination, a player is given one of the various wins preset in the slot machine. With a win, the player is rewarded with payment of a preset number of coins, which are two to fifteen.

There have been recent slot machines in which it is possible to play not only the normal games but also bonus games, which have an appearance and operation different from those of the normal games, to attract players and heighten their interest in playing games. Among plural kinds of wins ranked differently, there is a big win or specific win, which can be given when a combination "7-7-7" appears along a winning line. Upon the occurrence of the big win, a great number of, for example 15, coins are paid out to the player. One or more bonus games are played next.

To play a bonus game, the reels are used as in normal games. A series of bonus games is executed in a manner as follows: a player inserts a coin. The three reels are started rotating at the same time. One of the three reels is stopped at first. If one of symbols around the stopped reel which indicates a bonus win is stopped along a winning line, then a bonus win is provided to pay out 15 coins to the player. Similar operations follow regarding the remaining two reels. Namely, the rotation of each reel is associated with the possibility of acquiring a bonus win. Subsequently the player inserts another coin, and causes the three reels to rotate. Then the series of bonus games is terminated when twelve bonus games are played, or when six bonus wins are given in less than twelve bonus games.

Playing a bonus game is far more advantageous than playing a normal game, because as many as 15 coins can be paid out for a simple stopping of one symbol on one reel before the remaining two reels stop. In other words, a player playing a bonus game enjoys a heightened probability of acquiring rewards over a normal game. The player can collect coins in increased numbers when playing bonus games. Accordingly, it is one of the greatest concerns to a player of a slot machine whether he can play bonus games.

In conventional slot machines, however, the appearance of the reels operated during bonus games is less spectacular and less attractive visually than in normal games, as each bonus win is caused by rotation of only a single reel. Although playing a bonus game is quite advantageous to a player, the less dramatic appearance of the reels in bonus games belies the advantageous situation of the player. Thus the conventional manner of operation in bonus games is likely to less then player's interest in playing games or the satisfaction of acquiring wins.

In conventional slot machines, the reels are provided with symbols used in normal games, including PLUM and LEMON, and bonus symbols, which are overlapped on PLUM, LEMON and the like, and used in bonus games to represent a bonus win, in such form as JAC or AAA. The reels thus have an excessively complicated appearance due to the combination of symbols for normal games and for bonus games. It is difficult for beginning players to discern those symbols. The conventional reels are disadvantageous also because of the difficulties of modifying the routines of bonus games if a designer of a slot machine has a new concept of bonus games for the purpose of seeking to impart further attractiveness to the slot machine.

SUMMARY OF THE INVENTION

In view of the foregoing problems, an object of the present invention is to provide a slot machine of highly attractive appearance in which bonus games can be played.

Another object of the present invention is to provide a slot machine in which the routine of executing a bonus game can be freely modified when the designer of the slot machine has a new concept of bonus games.

In order to achieve the above and other objects and advantages of this invention, a game is played in a slot machine to provide a win or loss, the win being one of plural kinds including a normal win, a specific win, and a bonus win. The game itself is also of plural kinds, including a normal game and a bonus game. A bonus game is allowed when a specific win occurs upon playing a normal game. A first reel set includes P normal reels of which the symbols are arranged on the periphery. The normal reels are rotated for a normal time. The normal reels are stopped to determine the normal win or the specific win, in accordance with a combination of symbols of the normal reels along a predetermined first winning line. At least one specific reel has symbols, which are arrange on the periphery thereof. The specific reel is rotated in the bonus game. The specific reel is stopped to determine the bonus win, in accordance with whether a symbol on the specific reel stops on a predetermined second winning line.

In a preferred embodiment, the slot machine includes P+Q reels. First to Pth ones of the reels are rotated together, to play a normal game. (P+1)th to (P+Q) th ones of the reels are rotated, to play a bonus game.

In the present invention, bonus games can be played with a highly attractive appearance. The routine of executing a bonus game can be freely modified when the designer of the slot machine has a new concept of bonus games.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
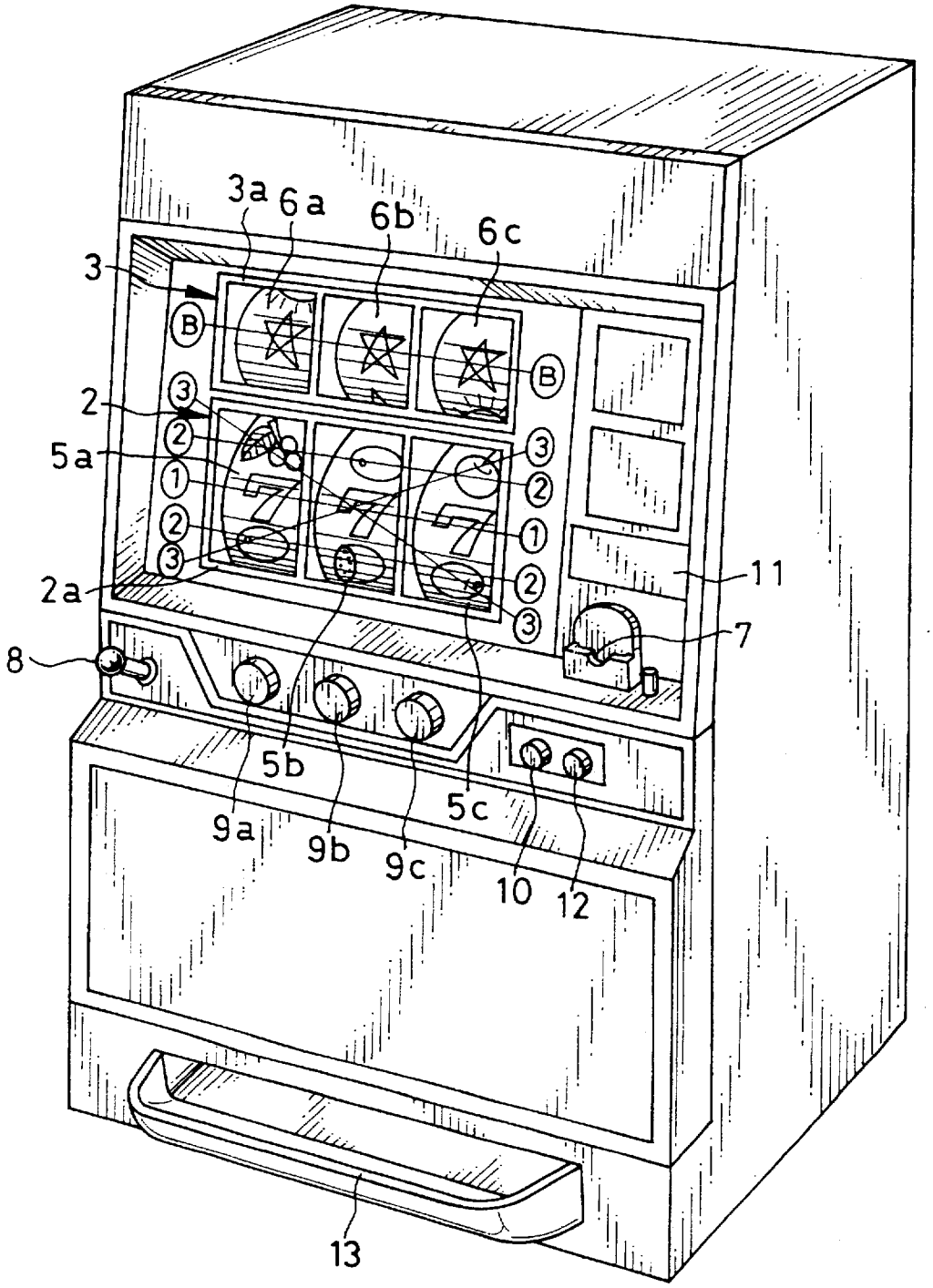
FIG. 1 is a perspective view illustrating a slot machine of the present invention.

In FIG. 1 illustrating a slot machine of the present invention, a display window 2 is formed in a front panel for normal reels 5a to 5c to be rotated in a normal game. A display window 3 is formed above the display window 2 for specific reels 6a to 6c to be rotated in a bonus game or specific game, which is enabled if a predetermined condition is met.

Behind the display window 2, the three normal reels 5a to 5c are disposed in rotatable fashion about their horizontal shafts. The normal reels 5a to 5c constitute a first reel set, which is used in normal games. Behind the display window 3, the three specific reels 6a to 6c are disposed in rotatable fashion about their horizontal shafts. The specific reels 6a to 6c constitute a second reel set, which is used in bonus games. The periphery of each of the normal reels 5a to 5c and 6a to 6c has symbols. Inside the display window 2, three symbols on each of the normal reels 5a to 5c appear at a time externally. Inside the display window 3, one symbol on each of the specific reels 6a to 6c appears at a time externally.

A window frame 2a surrounding the window 2 and a window frame 3a surrounding the window 3 consist of covering members of white translucent plastic, and normal game indicator or bonus game indicator 34 (see FIG. 2) is incorporated behind the covering members. The normal or bonus game indicator consists of light-emitting diodes (LED). When playing a normal game with the normal reels 5a, 5b and 5c of the first reel set, the indicator in the window frame 2a is blinked to indicate visually the play of a normal game. When playing a bonus game with the specific reels 6a, 6b and 6c of the second reel set, the indicator in the window frame 3a is blinked to indicate the play of a bonus game. The LEDs in the window frame 3a illuminate in a single color, while the LEDs comprising bonus game indicator 34 in the window frame 3a are operated to illuminate in plural different colors. Accordingly the indication of a bonus game is more conspicuous than that of a normal game.

In the first reel set, 21 symbols are formed on each of the normal reels 5a to 5c, and include "7" and "CHERRY" and other fruits as illustrated in the drawings. As is common in conventional slot machines, a win is given when the reels are so stopped that three identical symbols are stopped along a validated winning line, which may be included in plural winning lines across the display window 2. Regarding the symbol CHERRY, a win is given differently, i.e. given when one or two CHERRYs are stopped along a validated winning line. On the specific reels 6a to 6c of the second reel set, there are formed four kinds of symbols and eight symbols, which are SUN, MOON, STAR and "blank" appearing respectively twice. None of the symbols SUN, MOON, STAR and "blank" is included in the first reel set.

The specific reels 6a, 6b and 6c of the second reel set have a smaller diameter than the normal reels 5a to 5c of the first reel set. Each of the specific reels 6a to 6c has a smaller number of symbols than those around the normal reels 5a to 5c. For the specific reels 6a to 6c of the second reel set, a single winning line is defined horizontally across the arrangement of the specific reels 6a to 6c. In a bonus game, the combination of symbols stopped along the winning line is automatically checked. If it coincides with a certain winning combination, then a win is given. In a bonus game, the specific reels 6a to 6c of the second reel set are stopped one after another. If a symbol other than the "blank" is stopped on the winning line, then a bonus win is given. The probability of a bonus win is higher than for any win associated with a normal game. Upon the stopping of all the specific reels 6a to 6c, if there are two identical symbols other than "blank" on the winning line, then a combined bonus win is given.

In the front panel of the slot machine, there are disposed a coin inlet slot 7, a start lever 8 and stop buttons 9a, 9b and 9c. There are marks 1, 2 and 3 disposed beside the display window 2 and associated with the five winning lines. Behind the marks of 1, 2 and 3, line indicating lamps 33 (see FIG. 2) are incorporated. Prior to the start of a normal game, one, two or three coins are inserted into the inlet slot 7. In response, the line indicating lamps 33 are selectively driven to illuminate the marks 1, 2 and 3 in association with the number of validated winning lines. When one coin is inserted, only the mark 1 is illuminated for one validated winning line. When two coins are inserted, the marks 1 and 2 are illuminated for three validated winning lines. When three coins are inserted, the marks 1, 2 and 3 are illuminated for five validated winning lines, inclusive of the three horizontal ones and two diagonal ones. The inlet slot 7 is used also prior to playing bonus games.

There is a credit-play button 10, which is depressed after a great number of coins are inserted into the inlet slot 7. One depression of the credit-play button 10 instructs the slot machine to play one coin by spending one of the inserted coins. A player can recognize the decrement of the inserted coins by checking an indicator 11, which indicates the present number of the inserted coins. If a command is entered to credit coins, the number of the credited coins is so controlled as to add the number of paid coins to the number of the credited coins. When a pay-out button 12 is depressed, all the credited coins are dispensed into a receptacle tray 13.

The start lever 8 is enabled to operate after insertion of the coin. Actuation of the start lever 8 starts the normal reels 5a to 5c rotating simultaneously for normal games, or starts the specific reels 6a to 6c rotating simultaneously for bonus games. The stop buttons 9a to 9c are enabled as soon as the normal reels 5a to 5c or 6a to 6c come to rotate at a constant speed after acceleration. When each of the stop buttons 9a to 9c is depressed, the reel associated with the depressed button is responsively stopped.

Figure 2:
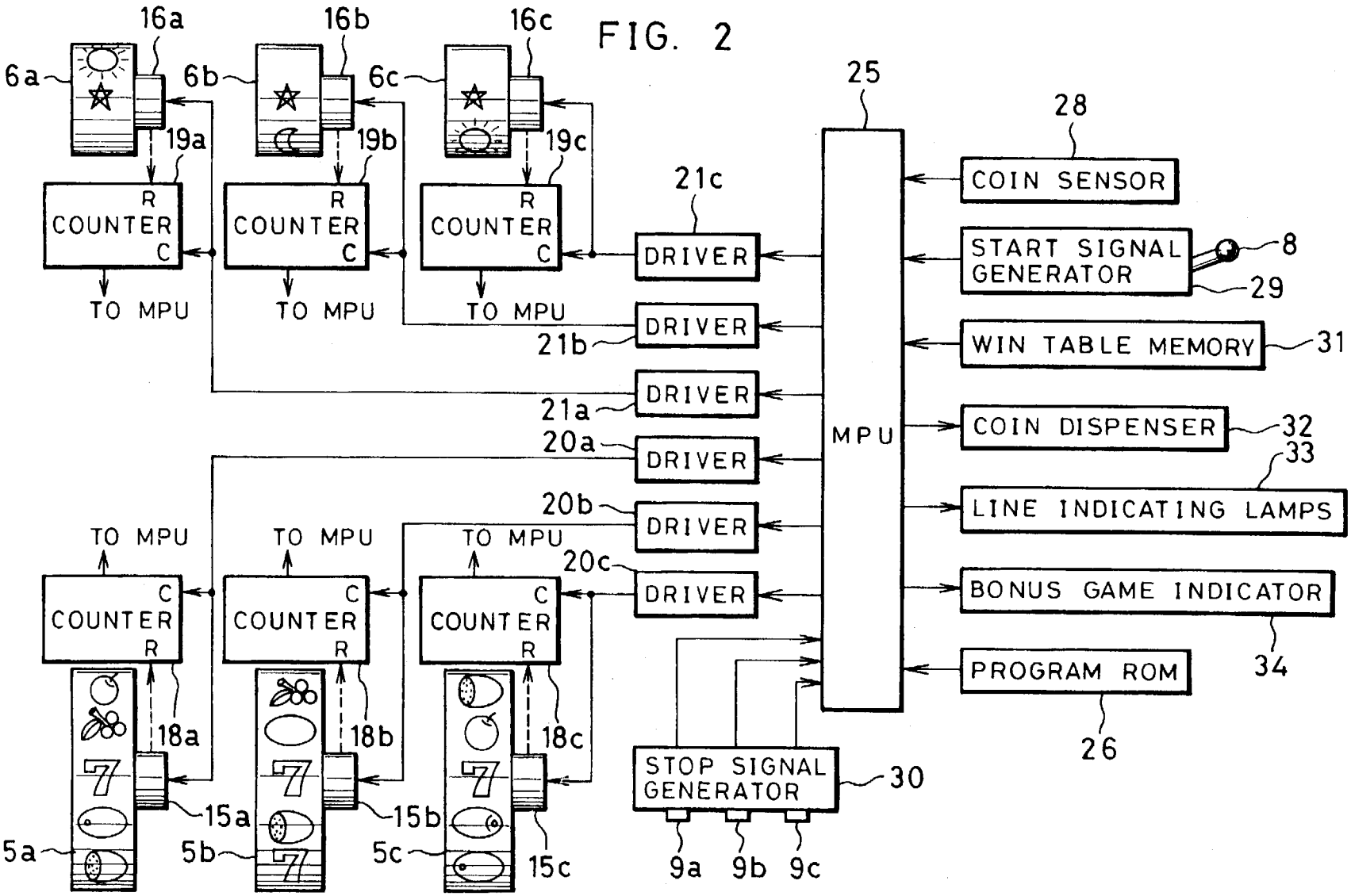
FIG. 2 is a schematic diagram illustrating circuitry of the slot machine of FIG. 1.

FIG. 2 illustrates circuitry of the slot machine. The normal reels 5a, 5b and 5c are directly driven by respective stepping motors 15a, 15b and 15c. The specific reels 6a, 6b and 6c are directly driven by respective stepping motors 16a, 16b and 16c. Counters 18a to 18c and 19a to 19c are associated with the respective stepping motors 15a to 15c and 16a to 16c, and count the drive pulses with which the stepping motors are supplied by drivers 20a to 20c and 21a to 21c. Each of the counters 18a to 18c and 19a to 19c has a count terminal C and a reset terminal R, by which the count in the counter is reset to zero upon movement of the stepping motor past its original position.

The arrangement of the symbols around the reels of the first and second reel sets is predetermined. One predetermined kind of symbol is associated with an original position of each stepping motor. When each reel is stopped, the count of the counter for the stopped reel is inputted into an MPU (microprocessor unit) 25, which electrically discerns which of the symbols is stopped along validated winning lines.

The MPU 25 generally controls the execution of the games in accordance with a gaming program stored in a program ROM 26. The MPU 25 is supplied with signals from a coin sensor 28, a start signal generator 29, and a stop signal generator 30. The coin sensor 28 detects a coin inserted into the inlet slot 7. The start signal generator 29 responds to operation of the start lever 8 to generate the start signal. The stop signal generator 30 responds to operation of the stop buttons 9*a*, 9*b* and 9*c* to generate the stop signal.

The MPU 25 refers to data stored in a win table memory 31 during the games, and supplies drive signals to a coin dispenser 32, the line indicator lamps 33 and a bonus game indicator 34. The table memory 31 stores win combination data representing win combinations of symbols in association with normal wins as a result of normal games, and numbers of reward coins in association with the win combination data. The table memory 31 also stores win combination data representing win combinations of symbols in association with bonus wins as a result of bonus games, and numbers of reward coins in association with the win combination data. The win table memory 31 is referred to by the MPU 25 to determine wins.

The coin dispenser 32 is driven upon an occurrence of a win for a game, and dispenses coins in a number associated with the size of the win to deposit them in the receptacle tray 13. The line indicator lamps 33 indicate which of the winning lines are validated in association with the number of inserted coins for the start of a normal game. The bonus game indicator 34 is driven when bonus games are trigger, and emits illumination by way of LEDs in the window frame 3*a* to indicate the play of a bonus game.

Figure 3:
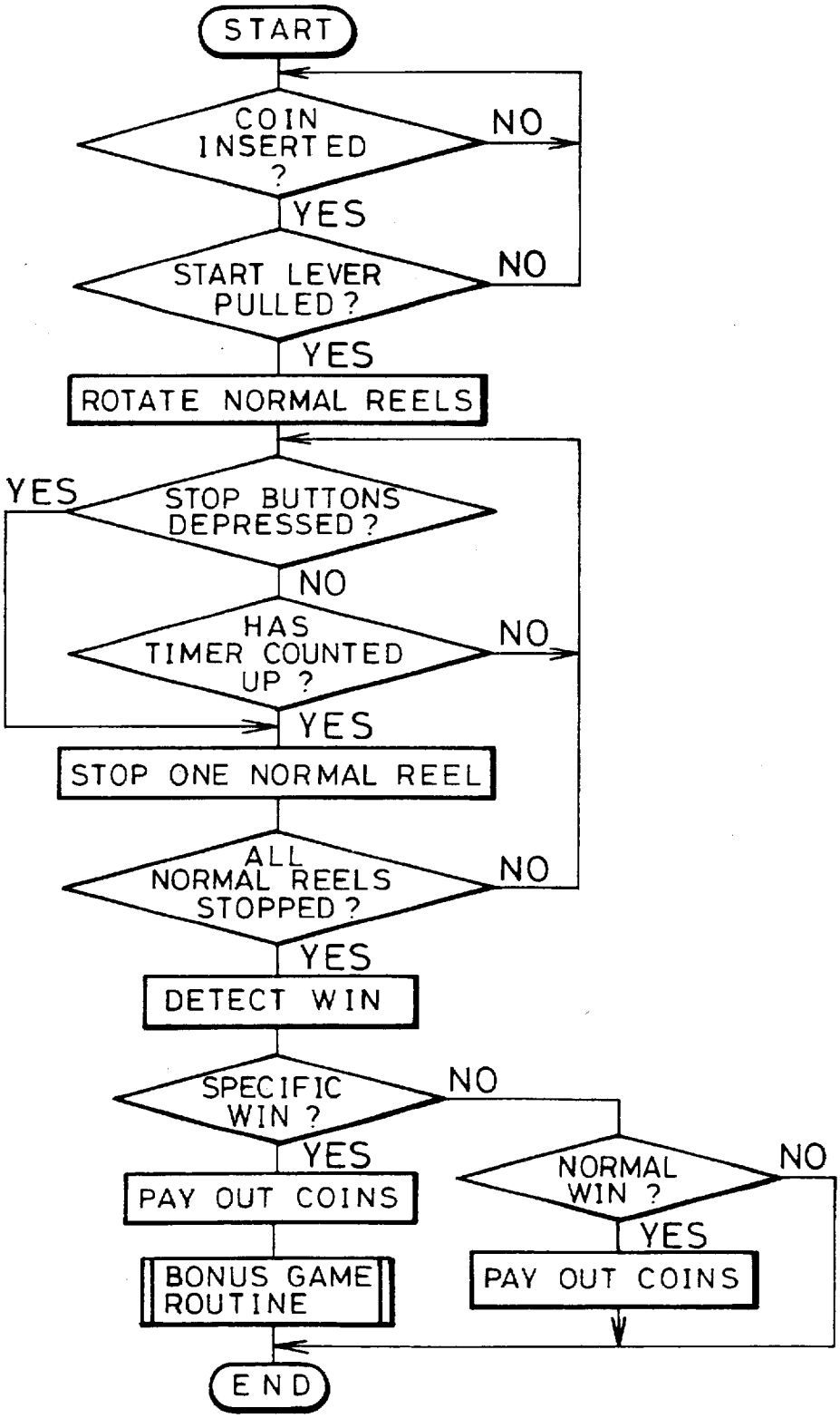
FIG. 3 is a flow chart illustrating a main routine of operation of the slot machine, including a normal game.
Figure 4:
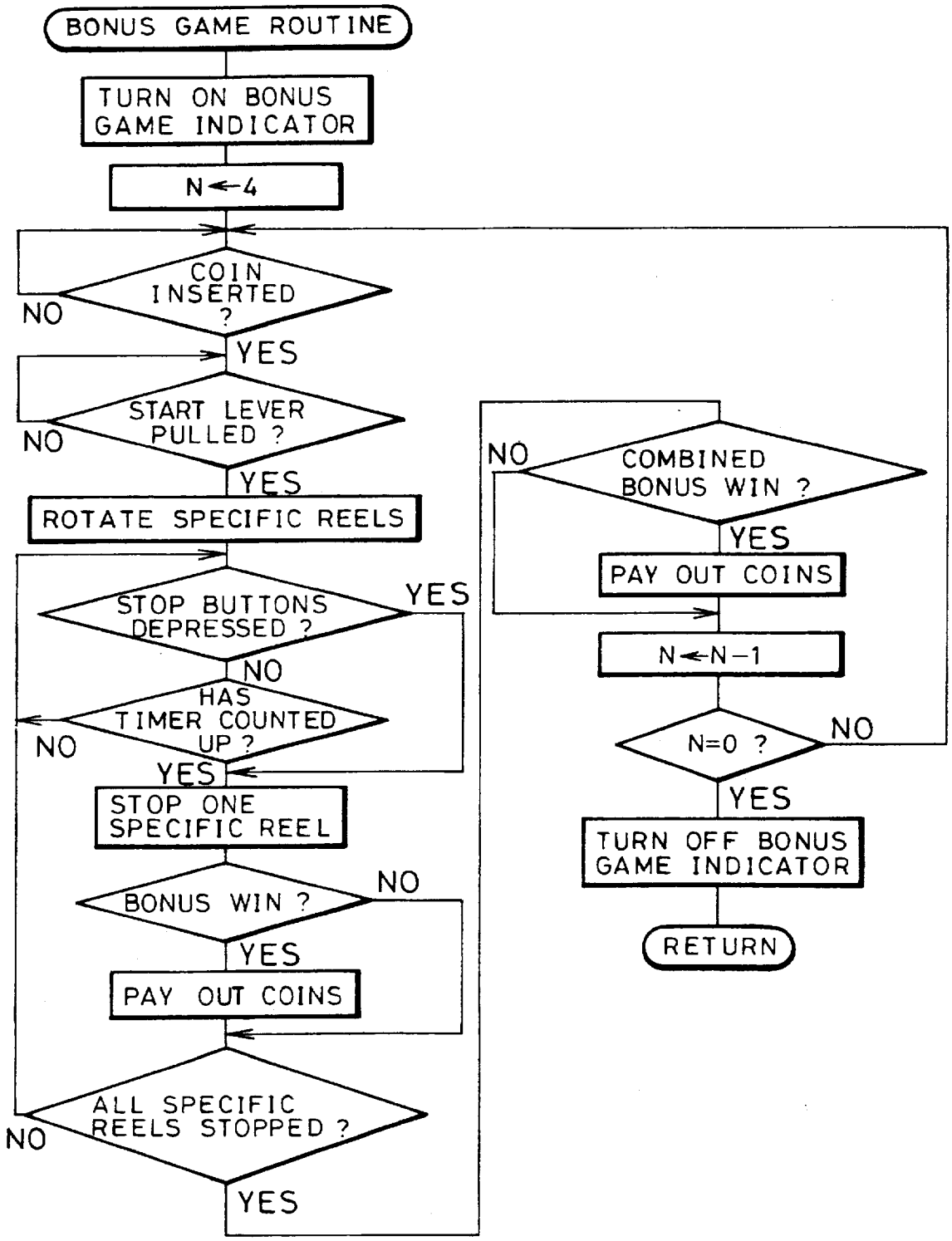
FIG. 4 is a flow chart illustrating a subroutine of the slot machine for a bonus game.

The operation of the above slot machine is described by referring further to the flow charts in FIGS. 3 and 4. A player inserts at most three coins through the inlet slot 7, and moves the start lever 8 to start a normal game. The normals reels 5*a*, 5*b* and 5*c* of the first reel set are started rotating simultaneously, and the rotational speed accelerates until the normal reels 5*a* to 5*c* rotate at their constant high speed. The stop buttons 9*a* to 9*c* are enabled. Then the stop buttons 9*a* to 9*c* are depressed in any order desired by the player. The depression of the buttons stops the supply of drive pulses for the stepping motors, to stop the reels. Note that, if the stop buttons 9*a* to 9*c* are never depressed during rotation of the reels 5*a* to 5*c*, the reels are automatically stopped, because drive pulses to the motors 15*a* to 15*c* are stopped upon counting up in a timer. This avoids unduly prolonging the duration of each game as played.

When all the normal reels 5*a* to 5*c* are stopped, there is made a judgment regarding the occurrence and the size of a win. As is described above, the counts in the counters 18*a* to 18*c* are read by the MPU 25. The data stored in the win table memory 31 for normal games is referred to, for detection of a normal win or loss, and the kind of the normal win. If a loss is detected, then the game is ended without any further step. If a normal win is detected, coins of which the number is associated with the kind of the normal win are paid out, to end the game.

As a result of win detection of the normal game, a "big" win is given as a specific win when a symbol combination "7-7-7" is stopped on a validated winning line. A predetermined number of, e.g. 15, coins are paid out, before triggering of a bonus game as illustrated in FIG. 4. The number of the coins paid out for the big win is predetermined to be greater than that for a normal win. It is to be noted that, in addition to "7-7-7", a big win or specific win can be provided in response to the stopping of a single specific symbol: each reel 5*a* to 5*c* can have a symbol "BIG". When at least one BIG is stopped on a validated winning line, responsively a big win can be determined.

When a bonus game is started, the bonus game indicator 34 is actuated to illuminate through the window frame 3*a*. The window frame 3*a* illuminates in visibly distinct plural colors, to display the occurrence of the bonus game so conspicuously, that not only the player at the slot machine but also other players and attendants around him are informed of the bonus game. In this way, the player about to play the bonus game is given great satisfaction.

To start a bonus game, one coin is inserted. The start lever 8 is operated. The specific reels 6*a* to 6*c* of the second reel set are started rotating simultaneously. The stop buttons 9*a* to 9*c* are depressed as desired by the player, to stop the second reel set, reel after reel. If the stop buttons 9*a* to 9*c* are never depressed, the specific reels 6*a* to 6*c* are stopped automatically upon counting up of the timer, in the same manner as for a normal game.

One of the reels of the second reel set is stopped. In response to this, the MPU 25 reads the count of the counter associated with the stopped reel among the counters 19*a* to 19*c*, and refers to data stored in the win table memory 31 for the bonus game, to detect the occurrence of a bonus win. On the specific reels 6*a* to 6*c* of the second reel set, there are formed eight symbols, which are SUN, MOON, STAR and "blank" appearing respectively twice. If a symbol other than "blank" is stopped on the winning line, then a bonus win is given. For a bonus win with the SUN symbol, 15 coins are paid out. For a bonus win with the MOON symbol, 10 coins are paid out. For a bonus win with the STAR symbol, five coins are paid out. It is of course possible to predetermine the numbers of the coins for those bonus wins differently as desired.

When all the reels of the second reel set are stopped, the MPU 25 further refers to data stored in the win table memory 31, and detects a symbol combination of the specific reels 6*a* to 6*c* stopped along the winning line. If at least two identical symbols other than "blank" are stopped along the winning line, then coins are paid out as a reward for a combined bonus win. If at least two SUNs are stopped, 30 coins are paid out. If at least two MOONs are stopped, 20 coins are paid out. If at least two STARs are stopped, 10 coins are paid out. It is possible to predetermine the numbers of the coins for those combined bonus wins differently as desired.

Thereupon, the first bonus game played with the one coin is ended. Then coins are successively inserted, to play three other bonus games in similar fashion. In other words, four bonus games are played in all. The number of the four games is predetermined as programmed in the flow chart of FIG. 4 at the step of "N←4". It is possible differently to predetermine the number of the bonus games as desired. Furthermore, it is possible to predetermine plural kinds of big wins or specific wins to occur upon playing normal games. With the different kinds of specific wins, it is possible to associate different numbers of playable bonus games.

When four bonus games are ended, the bonus game indicator 34 is turned off. The bonus game arrangement is placed on standby for a normal game. In the bonus games, the probability of winning is higher than for normal games.

The player will thus be likely to be rewarded with a greater number of coins. The second set of the specific reels 6a to 6c is marked for bonus games differently from the first set of the normal reels 5a to 5c for normal games, that is, the symbols provided for the second reel set are different from those of the first reel set, and are of types unfamiliar to players in gaming halls. Accordingly, the slot machine has a special interest for players playing games with it. In the present invention, bonus games are played with specific reels that are exclusive to the bonus games, which are also useful in further predetermining other variants of bonus games.

Figure 5:
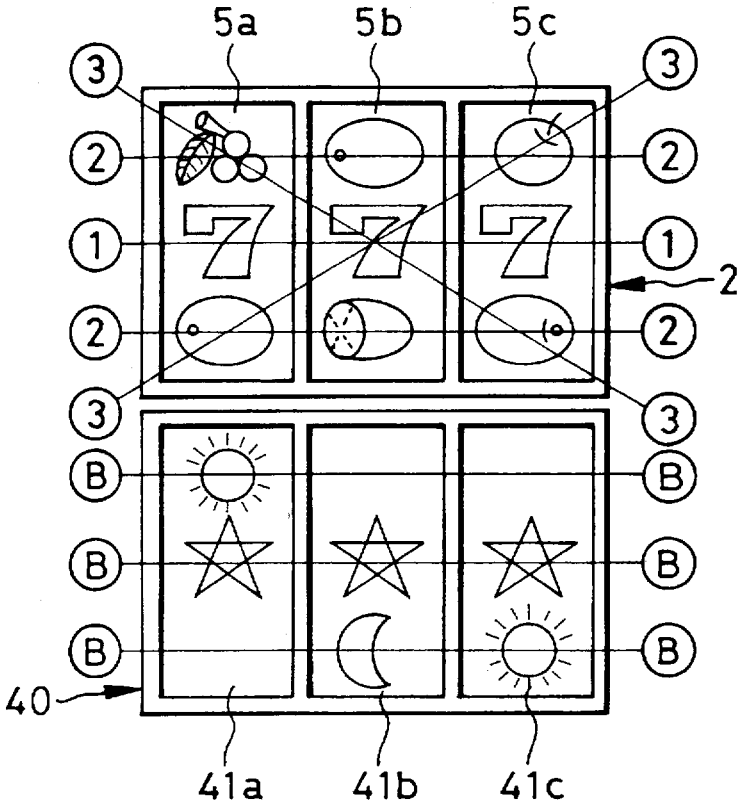
FIG. 5 is a schematic diagram illustrating other preferred sets of reels, of which specific reels are enlarged together with an enlarged window for the specific reels.

Referring to FIG. 5, another preferred embodiment of the present invention will now be described. Under the display window 2, there is formed another display window 40, which has a size equal to the display window 2 and is used for bonus games. There are reels 41a to 41c behind the display window 40 specific to bonus games. The specific reels 41a to 41c have a diameter equal to that of the normal reels 5a to 5c of the first reel set, and are also rotatable about a horizontal axis. The peripheries of the specific reels 41a to 41c are provided with symbols, which are used in bonus games, and are as many in number as the first reel set. Three of the symbols on each specific reel are observable through the display window 40. Three horizontal winning lines are defined across the display window 40 for the bonus games. All the winning lines are rendered effective in playing bonus games.

The embodiment of FIG. 5 has plural winning lines for bonus games. It is thus possible to heighten the probability of bonus wins and combined bonus wins. As compared with the former embodiment, the specific reels 41a to 41c can be provided with a greater number of symbols. It is possible to increase the kinds of symbols specified for bonus games, to enhance interest in the game. It is possible in addition to the horizontal winning lines to define two diagonal winning lines, in a manner similar to those for the reel set of normal games.

Figure 6:
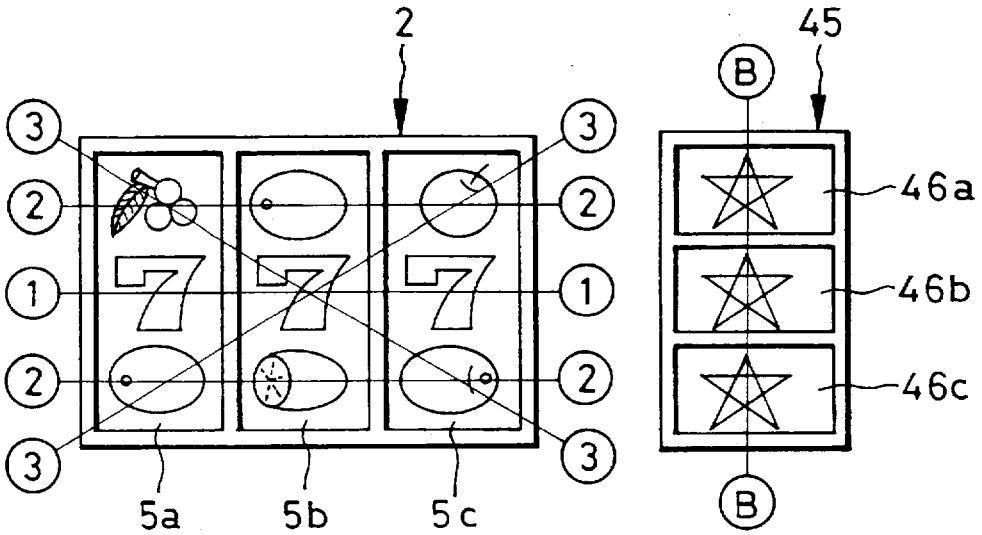
FIG. 6 is a schematic diagram illustrating still other preferred sets of reels, of which specific reels are horizontally rotatable.

FIG. 6 illustrates another preferred embodiment characterized by a vertically elongated display window 45 which is formed beside the display window 2. Reels 46a to 46c for bonus games are rotatable about a vertical rotational axis. The embodiment of FIG. 6 heightens the interest of the player playing bonus games, as the specific reels 46a to 46c for the bonus games are rotated differently from the normal reels 5a to 5c. It is of course possible to widen the display window 45 horizontally to a size wherein three of the symbols on each specific reel appear simultaneously. In FIG. 6, only one winning line is depicted. However, plural winning lines can also be formed by horizontally widening the display.

In the above embodiments, the slot machine has three normal reels for normal games. The present invention is however applicable to a slot machine having four or more normal reels for normal games. In the above embodiments, the slot machine has three specific reels for bonus games. The present invention is however applicable to a slot machine having one, two, four or more specific reels for bonus games. In the above embodiments, the specific reels for bonus games are as many in number as the normal reels for normal games. Alternatively, it is possible for bonus games to use a different number of normal reels from the number of specific reels for normal games. If fewer specific reels for bonus games are used, an advantage is the reduction of the space required for incorporation of the specific reels for bonus games. Such a slot machine will thus not be excessively large. It is possible to modify the size, position and orientation of the specific reels for bonus games as desired by design of the slot machine.

In the above embodiments, the triggering of the bonus games is conditioned to occur upon stopping of "7-7-7" along a winning line of the normal reels. Alternatively, the triggering of the bonus games can be conditioned differently. The bonus games may be triggered upon stopping of one particular symbol (such as "BIG") on one of the winning lines. It is further possible to vary the symbols around the reels. In the above, there is no symbol common to the reels for the bonus games and the normal games. However it is possible for variant specific reels to include some of the symbols for the normal games. Symbols "7" can be included on the reels for bonus games. It is possible to set an extraordinarily big win which can be given on the occurrence of the stopped combination of "7-7-7" on the normal reels with the stopped combination of "7-7-7" on the specific reels. For the extraordinarily big win, hundreds of coins may be paid out.

The present invention is also applicable to a slot machine which has only one stop button, and in which the three reels can be stopped at different moments successively after manual depression of the stop button. It is possible to design the slot machine such that the stop button must be depressed three times, or can be depressed only once, to trigger the stopping of the three reels.

The present invention is also applicable to a slot machine which does not have any stop button, and in which the reels are automatically stopped at random.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

I claim:

1. A slot machine in which a game is played to provide a win or a loss, said win being one of plural kinds including a normal win, a specific win, and a bonus win, said game being one of plural kinds including a normal game and a bonus game, said bonus game being allowed when said specific win is provided upon playing of a said normal game, said slot machine comprising:

a first reel set, including P normal reels having symbols arranged on their peripheries, P being at least two, said normal reels rotating during a said normal game, said normal win or a said specific win, in accordance with the combination of symbols on said normal reels stopping along a predetermined first winning line displayed in a first window; and at least one specific reel having symbols arranged on its periphery, said specific reel rotating during a said bonus game, said specific reel stopping to display a said bonus win in a second window spaced from said first window, in accordance with the presence of at least one symbol on said specific reel in a predetermined winning position.

2. A slot machine as defined in claim 1, further comprising:

a controller for selecting one of said normal game and said bonus game;

a first driver section, connected to said controller, for driving said normal reels respectively to rotate together when said normal game is selected through said controller; and a second driver section, connected to said controller, for driving said at least one specific reel to rotate when said bonus game is selected through said controller.

3. A slot machine as defined in claim 1, further comprising:

a first position detector device, associated with said normal reels, for detecting respective stopped positions of said normal reels, an address constituted by a combination of said stop positions of said normal reels; and a win table memory for storing data on said win at said address, said controller accessing said win table memory at said address, to determine the occurrence of a said win and said kind of said win.

4. A slot machine as defined in claim 1, wherein said game is played by betting a coin, coins are paid out when said win occurs, and said specific win pays out a greater number of coins than said normal win.

5. A slot machine as defined in claim 1, wherein said symbols arranged around said specific reels are different from said symbols arranged around said at least one normal reel.

6. A slot machine as defined in claim 3, wherein said at least one specific reel comprises Q specific reels, Q being at least two, said specific reels include a first specific reel and Q-1 second specific reels, and together constitute a second reel set, and are rotated together to play said bonus game.

7. A slot machine as defined in claim 6, wherein a controller starts said Q specific reels rotating for said bonus game, stops said first specific reel, and subsequently stops said second specific reels, and said controller re-triggers said normal game after playing of at least one said bonus game;

further comprising a second position detector device associated with said Q specific reels, for detecting respective stopped positions of said specific reels;

wherein said win table memory further stores data of said bonus win and data of a combined bonus win, an address of said bonus win data being a stopped position of said first specific reel, an address of said combined bonus win data being a combination of said stopped positions of said Q specific reels, and said controller determines said bonus win and said combined bonus win, in accordance with said detected stopped positions of said Q specific reels.

8. A slot machine as defined in claim 7, wherein a said bonus game is played by betting a single coin, and said controller re-triggers said normal game after playing of N bonus games, wherein N is a predetermined number of at least one.

9. A slot machine as defined in claim 1, wherein said normal reels and said at least one specific reel are rotated respectively about horizontally oriented axes.

10. A slot machine as defined in claim 1, wherein said normal reels are rotated about a horizontally oriented axis, and said at least one specific reel is rotated about a vertically oriented axis.

11. A slot machine as defined in claim 1, wherein said at least one specific reel has a diameter substantially equal to a diameter of said normal reels, and has as many different symbols as said symbols on said normal reels.

12. A slot machine as defined in claim 6, wherein P=Q, and said normal reels and said specific reels are arranged in a 2×P matrix.

13. A slot machine as defined in claim 1, wherein said at least one specific reel has a diameter smaller than a diameter of said normal reels, and has fewer different said symbols than said normal reels.

14. A slot machine as defined in claim 6, wherein said first winning line comprises plural lines, and said winning position is a single line.

15. A slot machine as defined in claim 1, further comprising a bonus game indicator, disposed closely to said second window, and driven during a said bonus game, for indicating execution of said bonus game.

16. A slot machine as defined in claim 15, wherein said bonus game indicator includes at least one light-emitting diode.

17. A slot machine as defined in claim 1, wherein said specific win is associated with at least one of a symbol combination comprising P symbols of a said common kind and a symbol combination containing at least one symbol of a said specific kind, said common kind and said specific kind being included in said symbols on said normal reels.

18. A method of controlling a slot machine, said slot machine including P+Q reels having symbols arranged on their peripheries, P being at least two and Q being at least one, said reels being rotated to play a game, said reels being stopped to display a win, in accordance with the combination of symbols on said reels stopping along a predetermined winning line, said win comprising a normal win or a specific win, said game comprising a normal win or a specific win, said game comprising a normal game and a bonus game, said bonus game being allowed when said specific win is displayed, said slot machine control method comprising the steps of:

rotating first the Pth ones of said reels together, to play said normal game;

rotating (P+1)th to (P+Q)th ones of said reels together, to play said bonus game; and displaying the symbols on the winning line of the (P+1)th to (P+Q)th ones of said reels in a display spaced from the first Pth ones of said reels.

19. A slot machine control method as defined in claim 18, further comprising the steps of:

storing data of a said win, an address of said win data being a combination of stopped positions of said first to Pth reels, said win being one of a normal win and a specific win;

detecting respective said stopped positions of said first to Pth reels; and determining said normal win or said specific win, in accordance with said detected stopped positions of said first to Pth reels.

20. A slot machine control method as defined in claim 18, wherein said first to Pth reels are rotated about a common horizontal axis, and said (P+1)th to (P+Q)th reels are rotated about a common vertical axis.

21. A slot machine control method as defined in claim 18, wherein said Q is an integer of at least 2.

22. A slot machine control method as defined in claim 18, further comprising the step of stopping said (P+1)th reel while said (P+1)th to (P+Q)th reels rotate together.

23. A slot machine control method as defined in claim 18, further comprising the steps of:

detecting a stopped position of said (P+1)th reel; and determining a bonus win, in accordance with said detected stopped position of said (P+1)th reel.

24. A slot machine control method as defined in claim 18, further comprising steps of:

stopping said (P+2)th to (P+Q)th reels after stopping of said (P+1)th reel;

detecting respective stopped positions of said (P+2)th to (P+Q) th reels; and determining a combined bonus win, in accordance with said detected stopped positions of said (P+1)th to (P+Q)th reels.

25. A slot machine including P+Q reels having symbols arranged on their peripheries, P being at least two and Q being at least one, said reels being rotated to play a game, said reels being stopped to display a win, in accordance with a combination of symbols of said reel stopping along a predetermined winning line, said win comprising a normal win or a specific win, said game comprising a normal game and a bonus game, said bonus game being allowed when said specific win is displayed, said slot machine further comprising:

means for rotating first to Pth ones of said reels together, to play said normal game;

means for rotating (P+1)th to (P+Q)th ones of said reels together, to play said bonus game; and a window for displaying the symbols on the winning line of said (P+1)th to (P+Q)th ones of said reels, said window being spaced from the first to Pth ones of said reels.

26. The slot machine of claim 25 further comprising a periphery for said window which is adapted to be illuminated when said bonus game is to be played.

* * * * *